US006897828B2

(12) United States Patent
Boucher

(10) Patent No.: US 6,897,828 B2
(45) Date of Patent: May 24, 2005

(54) ANTENNA ALIGNMENT SYSTEM

(76) Inventor: Christian Boucher, 2880, Cote St-Philippe Ouest, Mascouche, QBC (CA), J7K 3C3

( * ) Notice: Subject to any disclaimer, the term of this patent is extended or adjusted under 35 U.S.C. 154(b) by 181 days.

(21) Appl. No.: 10/424,820

(22) Filed: Apr. 29, 2003

(65) Prior Publication Data

US 2003/0201947 A1 Oct. 30, 2003

Related U.S. Application Data

(60) Provisional application No. 60/376,199, filed on Apr. 30, 2002.

(51) Int. Cl.[7] ..... H01Q 1/12
(52) U.S. Cl. ..... 343/890; 343/757; 343/874
(58) Field of Search ..... 343/757, 874, 343/878, 880, 882, 890

(56) References Cited

U.S. PATENT DOCUMENTS 5,248,225 A 9/1993 Rose
5,551,797 A 9/1996 Sanford
5,836,115 A 11/1998 Clay et al.
6,023,242 A * 2/2000 Dixon ..... 342/359
6,559,806 B1 * 5/2003 Watson ..... 343/766
6,690,917 B2 * 2/2004 Soliman et al. ..... 455/12.1
6,754,584 B2 * 6/2004 Pinto et al. ..... 701/215

* cited by examiner

*Primary Examiner*—Shih-Chao Chen

(57) ABSTRACT

A method of aligning an antenna within a predetermined azimuth direction, in which the antenna is hingeably connected to a support. In response to processed positioning data received by a first global positioning system receiver dish from a global positioning satellite system, the first receiver dish being connected to the antenna and locatable at predetermined first and second positions away from the antenna, the first receiver dish determines an antenna azimuth direction and is moved from the antenna azimuth direction towards the predetermined azimuth direction so as to align the antenna.

20 Claims, 3 Drawing Sheets

ANTENNA ALIGNMENT SYSTEM

CROSS REFERENCE TO RELATED APPLICATION

This application is related to U.S. provisional application for patent Ser. No. 60/376,199 filed on Apr. 30, 2002.

FIELD OF THE INVENTION

The present invention concerns an antenna, more particularly to a method of aligning the antenna within a predetermined azimuth direction.

BACKGROUND OF THE INVENTION

Wireless communications are now commonplace and rely on telecommunication antennae to transmit information to wireless devices such as mobile telephones including cellular, PCS, GMS and the like.

For maximum broadcast area coverage, the telecommunications antennae are located at high altitudes, such as on transmission towers and hi-rise buildings. The antennae must be aligned with a reference point, especially in azimuth (within a horizontal plane), with a considerable degree of precision for optimum broadcast and reception quality in addition to achieving a maximum broadcast range. Typically, for antenna alignment, surveyors are used to align the antenna using given coordinates and geodesic reference points, which are typically taken at ground level. Once this information is processed, an installation expert is required to ascend the structure and gradually align the antenna using an iterative process, using the coordinates furnished by the surveyors. After this adjusting procedure is complete, the installer bolts the antenna securely to its base and moves on to the next antenna.

While this procedure is relatively straightforward, it suffers from a number of significant disadvantages. On-site calculations require two highly trained people on the ground to gather pertinent information, which then must be processed and registered by the surveying company. This is often expensive, especially if multiple measurements are to be made. In addition, the procedure often requires hiring individuals with expertise in working at high altitudes, such as high steelworkers and wall scalers. Again, this can further increase the expense of aligning the antenna.

Thus there is a need for an improved antenna alignment system.

SUMMARY OF THE INVENTION

The present invention reduces the difficulties and disadvantages of the aforesaid problems by providing a simple method of aligning an antenna with a remote emitter reference point using GPS. Advantageously, the alignment method essentially eliminates the need for expensive and time-consuming iterative data processing by surveyors and dissemination of the data to antenna alignment personnel in the field. In addition, the present method antenna alignment method can be performed, in conditions of poor visibility, such as at night or in fog, rain, snow, or clouds. The method is inexpensive and simple to use and provides the user a reliable and accurate way of aligning the antenna. The novel method is typically accomplished by using two global positioning system receiver dishes and a global positioning satellite, which relay information to a user on-site to enable him to align the antenna with a predetermined azimuth direction. Only one receiver dish, in movable relationship relative to the antenna, could be used to perform the antenna alignment. Moreover, the system is portable and can be temporarily attached to an existing antenna for measurements to be made and then quickly disassembled to move to the next antenna.

In a first aspect of the present invention, there is provided a method of aligning an antenna within a predetermined azimuth direction, said antenna being hingeably connected to a support, said method comprising: in response to processed positioning data received by a first global positioning system receiver dish from a global positioning satellite system, said first receiver dish being connected to said antenna, said first receiver dish being locatable at predetermined first and second positions away from said antenna, determining an antenna azimuth direction and moving said first receiver dish from said antenna azimuth direction towards said predetermined azimuth direction so as to align said antenna.

In a further aspect of the present invention, there is provided an antenna alignment system, having an antenna hingeably connected to a generally vertical support, for aligning said antenna within a predetermined azimuth direction, said system comprising: a support arm releasably connected to said antenna; a first global positioning system receiver dish connected to an upper portion of said support arm, said first receiver dish being locatable at predetermined first and second positions away from said antenna; said first receiver dish being in communication with a global positioning satellite system for processing positioning data received therefrom when in said first and second positions to determine an antenna azimuth direction so as to allow aligning said antenna by moving said first receiver dish from said antenna azimuth direction to said predetermined azimuth direction.

Other objects and advantages of the present invention will become apparent from a careful reading of the detailed description provided herein, with appropriate reference to the accompanying drawings.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purposes and by no means as of limitation.

Figure 1:
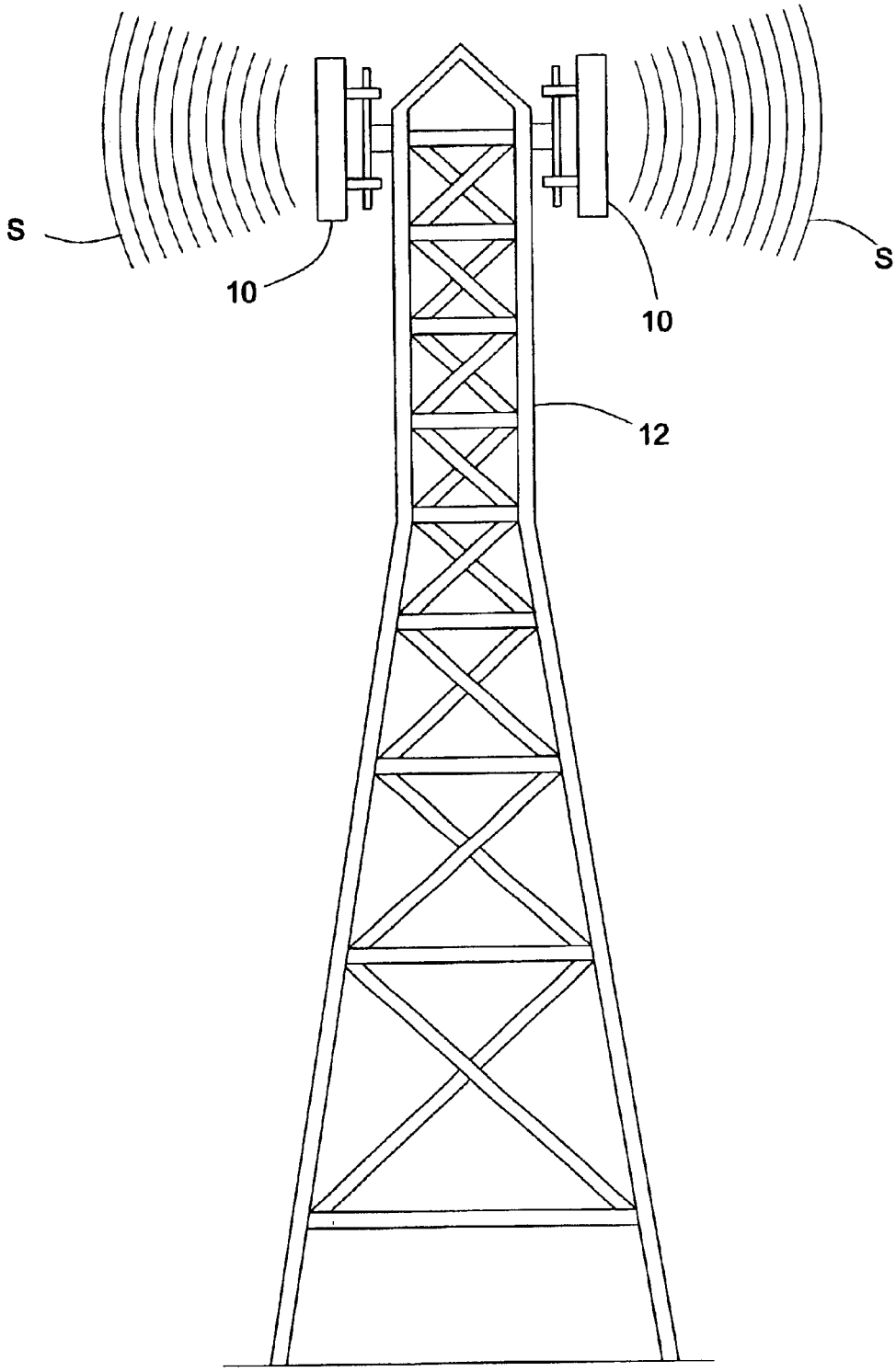
FIG. 1 is a simplified front elevation view of antennae on a high steel transmission tower.

Referring to FIG. 1, there is shown a typical ground telecommunication antenna 10 installed on a high structure such as a transmission tower 12.

Figure 2:
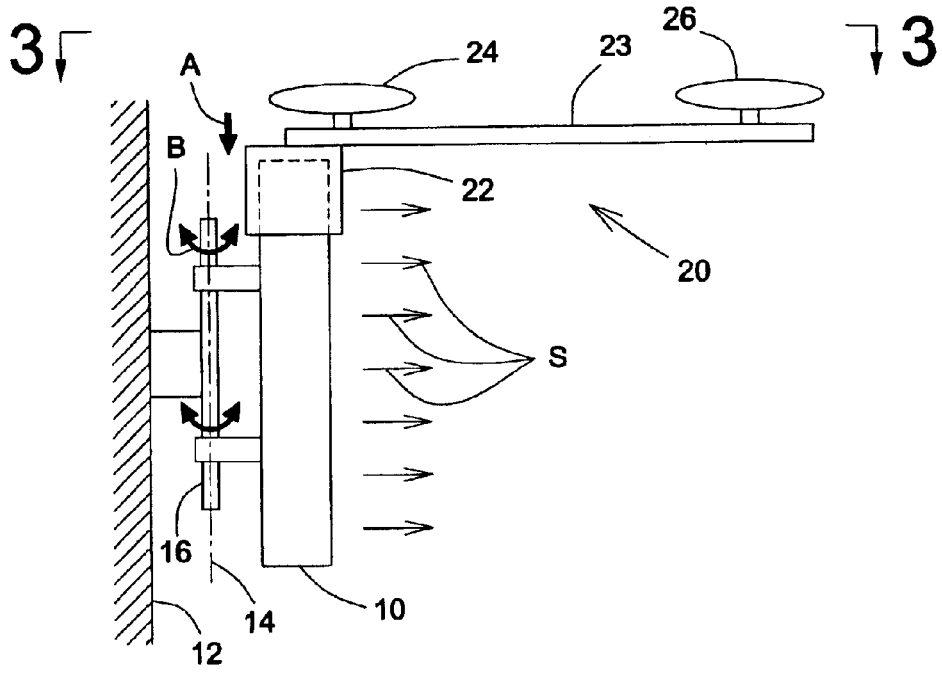
FIG. 2 is a simplified side elevation view of an antenna alignment system showing the antenna alignment system mounted on an antenna to be aligned.
Figure 3:
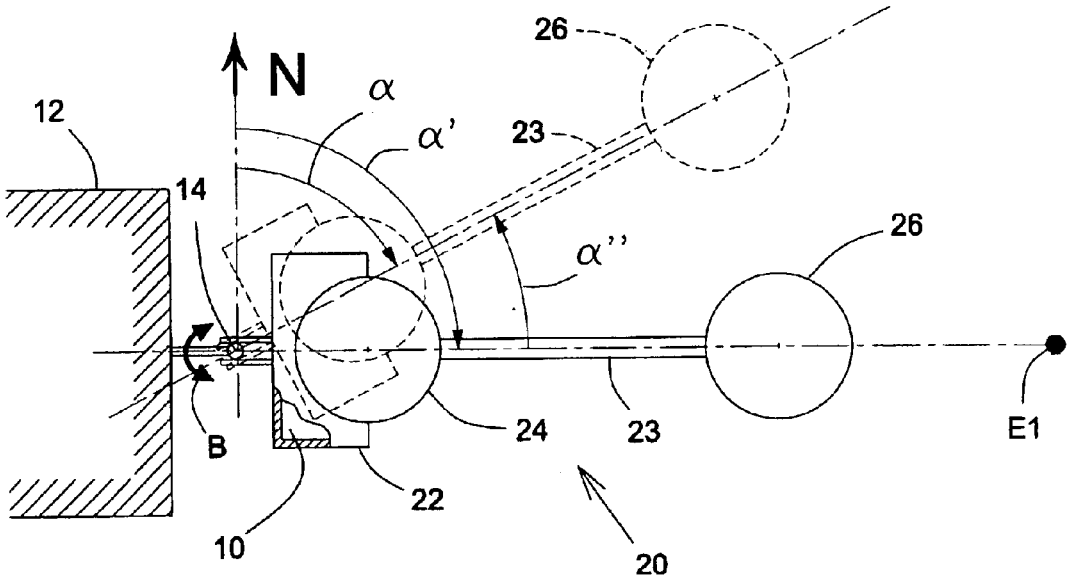
FIG. 3 is a simplified top plan view of FIG. 2, taken along lines 3—3, showing an azimuth angle of the antenna being aligned.

Referring to FIGS. 2 and 3, there is shown an antenna alignment system 20 in accordance with a preferred embodiment of the present invention; the alignment system 20 is typically temporarily mounted on the antenna 10 to be aligned, as schematically illustrated by arrow A of FIG. 2. The alignment system 20 includes of a universal setting frame 22, which rigidly supports a substantially horizontally positioned support arm 23 of approximately 2.5 meters long, the latter could be extended according to the alignment precision required by the client. The support arm 23 typically is a measuring device, such as a ruler, the use of which is described below. The frame 22 releasably mounts on the antenna 10. The alignment system 20 is pivotally fixed to the antenna 10 in such a way that the frame 22 is restrained from rotation movement relative to the antenna 10 and the support arm 23 remains generally extended in a radial direction relative to the vertical axis 14 about which the antenna is mounted on the structure 12. Preferably, the support arm 23 extends in the direction corresponding of the direction of the signal S transmitted and/or received by the antenna 10, or any other known angle relative thereto.

Typically fixed atop and at either end of the support arm 23 are two GPS (Global Positioning System) satellite system receiver dishes, one being a mobile satellite reception dish 24 and the other being a base satellite reception dish 26 for receiving positioning data from a global positioning satellite and located at predetermined first and second positions away from the antenna 10 and from each other. The distance between the two dishes 24, 26 can be accurately determined using the arm support as a measuring device. The two dishes 24, 26 are in communication with each other, either via radio wave or cables, via a controller (not shown). The controller is typically a hand-held device, which continuously provides a technician with an azimuth angle between the two dishes 24, 26, i.e. the pointing azimuth direction of the arm support 23 (of the antenna 10 in this case) relative to the geometric North direction N. The controller performs, and processes, a simple trigonometric calculation using the data related to the positioning of the two dishes 24, 26 on the support arm 23, using well known GPS technology, Real-Time-Kinematic (RTK) system or the like, is able to relay the required azimuth angle to the technician. The technician then adjusts the antenna 10 by rotating it along with the alignment system 20 about the vertical axis 14 of the antenna rotation shaft 16, as illustrated by arrows B of FIG. 3 in which two different azimuth angle positions $\alpha$, $\alpha'$ are shown in solid and doffed lines respectively. When the antenna is properly aligned in azimuth along a required predetermined azimuth direction $\alpha$, the technician fixes the antenna 10 in place, disassembles the alignment system 20 therefrom and proceeds to the next antenna.

One skilled in the art will understand that a single receiver dish may also be used. In this case, the receiver dish 24 would be used in the predetermined first position located away from the antenna and then moved to the predetermined second position away from the antenna; measurements would be taken at both positions and then using the global positioning satellite system, the antenna would be moved within a predetermined azimuth direction. For typical applications, the GPS-RTK dishes 24, 26 are precise enough to provide an azimuth angle accuracy of approximately 0.5 degrees when they are approximately 2.5 meters away from each other, along the support arm 23.

For applications requiring the azimuth angle $\alpha$ to be measured with significant accuracy, the dish 26 may be placed a significant predetermined distance from the dish 24. Now referring to FIG. 4, an antenna alignment system 20*a* according to an alternative embodiment of the present invention differs from the first embodiment 20 by the fact that the base GPS antenna dish 26*a* is located at another fixed (not moving) location, such as on the ground G or the like in proximity to the structure 12 supporting the antenna 10 to be aligned.

Figure 4:
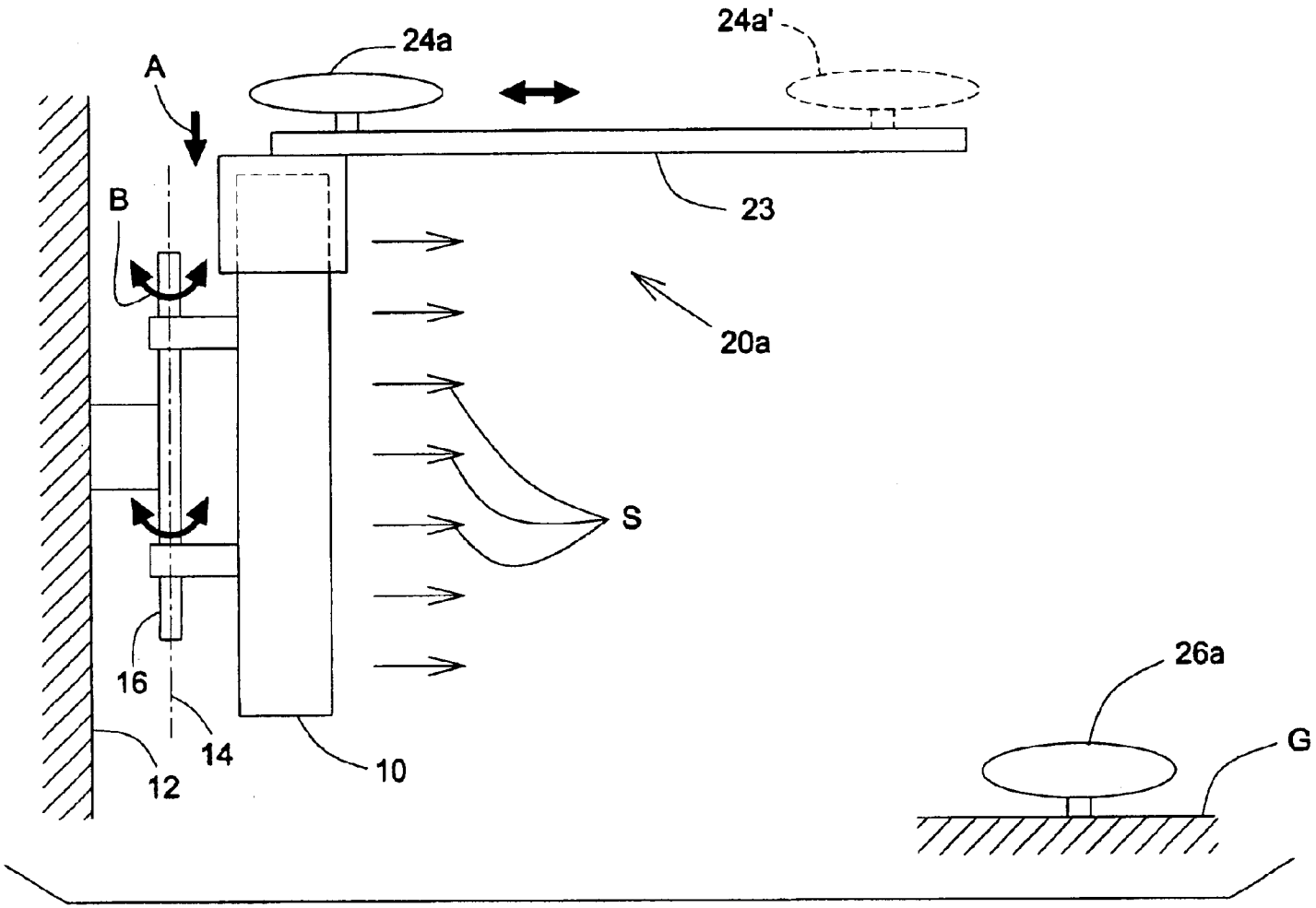
FIG. 4 is a simplified side elevation view of an alternative antenna alignment system in which part of the antenna alignment system is remotely located from the antenna to be aligned.

A first set of data is obtained with the two dishes 24*a*, 26*a*, when the dish 24*a* is in a first position on the ruler 23, closest to the antenna 10, as illustrated by solid lines in FIG. 4. The dish 24*a* may be slidably connected to the support arm 23, which enables the technician to displace, typically slidably, the dish 24*a* along the support arm 23 into a second position away from the antenna, as illustrated by dotted lines 24*a*' in FIG. 4, in which a second set of data is obtained. The controller, still connected to both dishes 24*a*, 26*a*, determines by computation from both sets of data the azimuth angle $\alpha$ between the first and the second positions of the mobile dish 24*a*, 24*a*'. By repeating the same procedure while rotating with the antenna and the alignment system, the technician will correctly align the antenna 10 when the controller indicates that the required predetermined azimuth direction $\alpha$ is obtained.

Referring now to FIG. 3, remote emitter reference point (shown as E1) may also be used to align either receiver dishes 24 or 26 therewith using conventional tracking radar system to track the remote emitter reference point E1. After alignment with the emitter reference point E1, whenever the receiver dish 24 or 26, along with the antenna 10, is rotated away therefrom, its relative azimuth direction $\alpha''$ is known and is used to reach the required predetermined azimuth direction $\alpha$ of the antenna 10.

Although the present antenna alignment system and method have been described with a certain degree of particularity, it is to be understood that the disclosure has been made by way of example only and that present invention is not limited to the features of the embodiments described and illustrated herein, but includes all variations and modifications within the scope of the present invention.

I claim:

1. A method of aligning an antenna within a predetermined azimuth direction, said antenna being hingeably connected to a support, said method comprising:

in response to processed positioning data received by a first global positioning system receiver dish from a global positioning satellite system, said first receiver dish being connected to said antenna, said first receiver dish being locatable at predetermined first and second positions away from said antenna, determining an antenna azimuth direction and moving said first receiver dish from said antenna azimuth direction towards said predetermined azimuth direction so as to align said antenna.

2. The method, according to claim 1, including:

processing said positioning data received at said first receiver dish from said global positioning satellite system.

3. The method, according to claim 2, including:

receiving said positioning data at said first receiver dish from said global positioning satellite system.

4. The method, according to claim 3, further comprising a second global positioning receiver dish connected to said antenna, said second receiver dish being in communication with said first receiver dish.

5. The method, according to claim 4, in which:

said second receiver dish is mounted on the ground, at a predetermined distance away from said first global positioning receiver dish.

6. The method, according to claim 4, in which said first and second global positioning receiver dishes are mounted on a support arm.

7. The method, according to claim 6, in which said first and second receiver dishes are located at said predetermined first and second positions away from said antenna, respectively.

8. The method, according to claim 6, in which said support arm is releasably connectable to said antenna.

9. The method, according to claim 1, in which:

said first receiver dish is slidably mounted on a support arm.

10. The method, according to claim 5, in which said second receiver dish is an emitter reference point.

11. The method, according to claim 1, in which said antenna is hingeable about a generally vertical axis.

12. An antenna alignment system, having an antenna hingeably connected to a generally vertical support, for aligning said antenna within a predetermined azimuth direction, said system comprising:

a support arm releasably connected to said antenna;

a first global positioning system receiver dish connected to said support arm, said first receiver dish being locatable at predetermined first and second positions away from said antenna;

said first receiver dish being in communication with a global positioning satellite system for processing positioning data received therefrom when in said predetermined first and second positions to determine an antenna azimuth direction so as to allow aligning said antenna by moving said first receiver dish from said antenna azimuth direction to said predetermined azimuth direction.

13. The system, according to claim 12, in which said first receiver dish is slidably mounted on said support arm.

14. The system, according to claim 12, further including a second global positioning system receiver dish located at a predetermined distance away from said first receiver dish and in communication therewith.

15. The system, according to claim 14, in which said first and second receiver dishes are connected to said support arm.

16. The system, according to claim 15, in Which said first and second receiver dishes are located at said predetermined first and second positions away from said antenna, respectively.

17. The system, according to claim 14, in which said second receiver dish is located on the ground a predetermined distance away from said first receiver dish.

18. The system, according to claim 17, in which said second receiver dish is an emitter reference point.

19. The system, according to claim 12, in which a data processor is in communication with said first receiver dish.

20. The system, according to claim 12, in which said antenna is hingeable about a generally vertical axis.

* * * * *